US005195911A

United States Patent [19]

Murphy

[11] Patent Number: 5,195,911

[45] Date of Patent: Mar. 23, 1993

[54] SHIELDED ELECTRICAL CONNECTOR WITH IMPROVED SHIELD

[75] Inventor: Paul Murphy, Des Plaines, Ill.

[73] Assignee: Molex Incorporated, Lisle, Ill.

[21] Appl. No.: 826,318

[22] Filed: Jan. 22, 1992

[51] Int. Cl.[5] ..... H01R 13/648

[52] U.S. Cl. ..... 439/607; 439/733

[58] Field of Search ..... 439/101, 108, 607, 608, 439/609, 610, 733

[56] References Cited

U.S. PATENT DOCUMENTS

| | | | |
|---|---|---|---|
| 4,544,227 | 10/1985 | Hirose | 439/607 |
| 4,718,866 | 1/1988 | Yamaguchi | 439/607 |
| 4,842,554 | 6/1989 | Cosmos et al. | 439/609 |
| 4,938,714 | 7/1990 | Kawai et al. | 439/607 |
| 4,946,400 | 8/1990 | Kawai et al. | 439/79 |
| 5,022,871 | 6/1991 | Sekiguchi | 439/609 |
| 5,035,651 | 7/1991 | Dixon et al. | 439/609 |

*Primary Examiner*—Paula A. Bradley
*Assistant Examiner*—Khiem Nguyen
*Attorney, Agent, or Firm*—A. A. Tirva

[57] ABSTRACT

An electrical connector is disclosed to includes a dielectric housing having a front face, a side wall and an opening extending rearwardly from the front face for receiving at least a portion of a mating connector. A shield of sheet metal material includes a front plate portion for abutting the front face of the housing at least adjacent the side wall thereof, and a rearwardly extending flange portion overlying at least a portion of the outside of the side wall of the housing. The shield further includes a grounding spring finger portion extending rearwardly into the opening in the housing, inside the side wall for engaging the mating connector. A locking finger portion of the shield projects into a locking recess in the outside of the side wall of the housing. The invention contemplates the provision of a slot in the front face of the housing between the opening and the side wall thereof. The shield includes a locking tab projecting into the slot to prevent movement of the shield which would lift the locking finger portion of the shield out of the locking recess on the outside of the housing when the mating connector engages the spring finger portion inside the opening in the housing. The locking tab is generally planar and includes a locking barb formed within the plane of the tab for interengagement with the housing within the slot.

3 Claims, 2 Drawing Sheets

SHIELDED ELECTRICAL CONNECTOR WITH IMPROVED SHIELD

FIELD OF THE INVENTION

This invention generally relates to the art of electrical connectors and, particularly, to an electrical connector which includes a dielectric housing surrounded at least in part by a metal shield and with an improved locking means between the shield and the housing.

BACKGROUND OF THE INVENTION

Shielded electrical connectors are available in a wide variety of configurations for RF and EMI shielding of the interior components of the connectors as well as protecting surrounding electronic components. One type of shielded connector includes a dielectric body having an opening for receiving a mating electrical connector, and a sheet metal shield surrounds at least part of the housing. This type of connector often is used as a semiconductor connector and may be mounted to a printed circuit board. The shield often has one or more spring fingers bent back into the opening in the housing for engaging a grounding component on the mating connector.

For instance, the dielectric housing may be formed in a cubic configuration, with the opening being either rectangular or circular for receiving the mating connector. The sheet metal shield usually has a front plate portion for engaging the front face of the housing and flange portions extending rearwardly and overlying one or more of the side walls of the housing. One such semiconductor connector includes a plurality of the grounding spring fingers extending into the opening inside one of the side walls of the housing, a flange portion extending rearwardly over the outside of the side wall, along with a locking finger portion projecting into a locking recess in the outside of the side wall. A problem encountered with such a structural combination is that, in some instances, when the mating connector is inserted into the opening in the housing to compress or bias the grounding spring fingers outwardly toward the inside of the housing side wall, the locking finger portion of the shield has a tendency to lift out of the locking recess on the outside of the housing side wall. This invention is directed to solving this problem by an improved locking means.

Another problem with shielded connectors of the character described is that they sometimes employ locking tabs which project into slots in the housing, the locking tabs being stamped with a lance configuration for engaging the plastic material of the housing within the slots. In other words, such shields are stamped and formed from sheet metal material. The locking tabs are generally planar. The tabs are stamped to have barbs or lances projecting from their edges for grippingly engaging the housing within the slots. With the ever-increasing miniaturization of semi-conductor connectors, it is very difficult to stamp a planar locking tab with edge locking barbs which, in combination with the extremely small tolerances in molding slots in a plastic housing, results in very little locking effect by such stamped locking tabs. This invention also is directed to solving those problems by an improved configuration of a locking tab for a sheet metal shield.

SUMMARY OF THE INVENTION

An object, therefore, of the invention is to provide a new and improved locking means between a sheet metal shield and a dielectric housing of an electrical connector.

In the exemplary embodiment of the invention, the locking means is incorporated in an electrical connector which includes a dielectric housing having a front face, at least one side wall and an opening extending rearwardly from the front face for receiving at least a portion of a mating connector. A shield of sheet metal material includes a front plate portion for abutting the front face of the housing at least adjacent the side wall thereof, a rearwardly extending flange portion overlying at least a portion of the outside of the side wall of the housing, a grounding spring finger portion extending rearwardly into the opening inside the sidewall for engagement by the mating connector, and a locking finger portion projecting into a locking recess in the outside of the side wall of the housing.

The invention contemplates slot means formed in the front face of the housing and located between the opening and the side wall of the housing. The shield includes a locking tab projecting into the slot means to prevent movement of the shield which would otherwise lift the locking finger portion of the shield out of the locking recess on the outside of the housing when the mating connector engages the spring finger portion of the shield inside the opening in the housing.

The shield is stamped and formed from sheet metal material, and the locking tab is stamped in a generally planar configuration. A feature of the invention includes a locking barb formed within the plane of the locking tab, i.e. within the bounds of the peripheral edges of the tab, for locking engagement in the slot means in the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
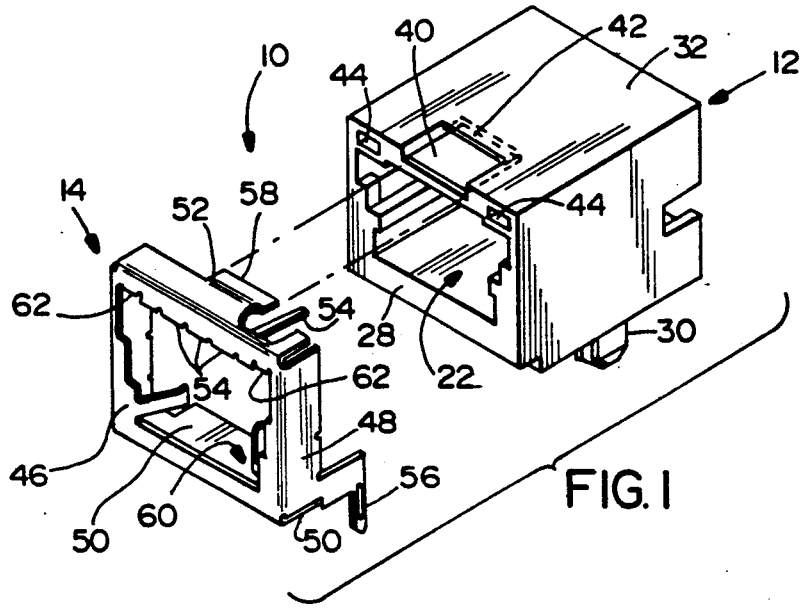
FIG. 1 is an exploded perspective view of an electrical connector embodying the concepts of the invention.
Figure 2:
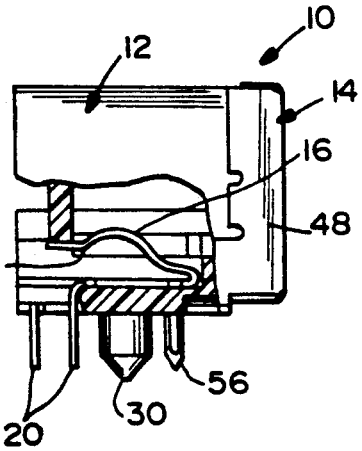
FIG. 2 is a side elevational view, partially broken away, of the electrical connector shown in FIG. 1.
Figure 3:
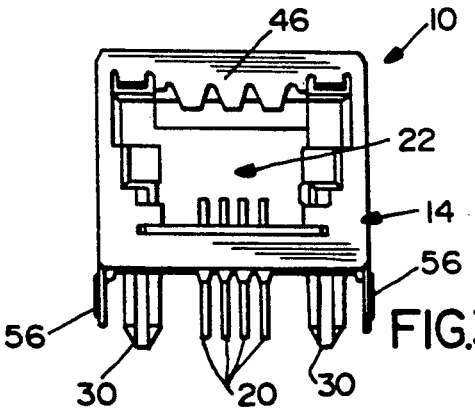
FIG. 3 is a front elevational view of the mating end of the connector of FIG. 2.

Referring to the drawings in greater detail and first to FIGS. 1-3, the invention is disclosed in an electrical connector, generally designated 10, which includes a dielectric housing, generally designated 12, and a shield, generally designated 14, mounted on the housing primarily about a front mating end thereof. The housing is unitarily molded of dielectric material such as plastic or the like. The shield is stamped and formed from sheet metal material.

Electrical connector 10 is of a generally conventional configuration to the extent that it is a semi-conductor electrical connector for mounting a plurality of terminals, generally designated 16, having spring contact arms 18 exposed within housing 12, along with solder tail portions 20 projecting beyond the bottom of the housing for insertion into appropriate holes in a printed circuit board for soldering to circuit traces on the board or in the holes. As seen in FIGS. 1 and 3, the connector has an opening, as indicated at 22, for receiving a complementary mating connector (not shown) which has terminals for engaging and making electrical contact with spring contact arms 18, depressing the arms downwardly upon insertion of the mating connector.

Figure 4:
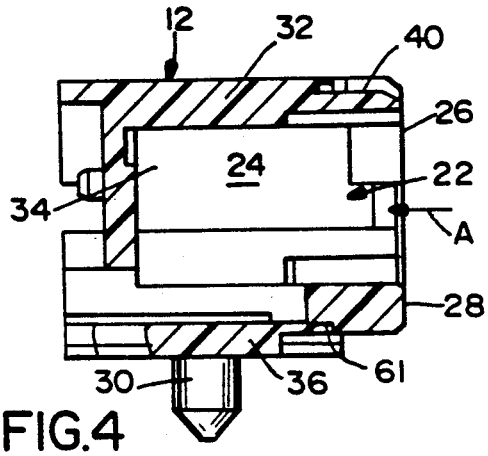
FIG. 4 is a front-to-rear section through the dielectric housing of the connector.
Figure 5:
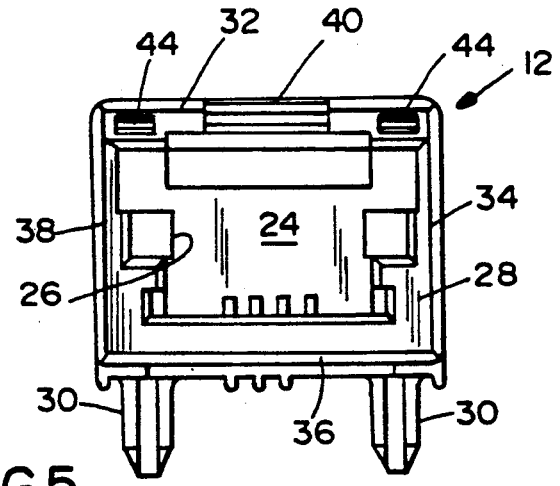
FIG. 5 is a front elevational view of the dielectric housing.

Referring to FIGS. 4 and 5 in conjunction with FIGS. 1 and 3, dielectric housing 12 includes an interior cavity 24 into which the mating connector is inserted through an open mouth 26 in a front face 28 of the housing. Integral mounting posts 30 depend from the underside of the housing for insertion int appropriate mounting holes in the printed circuit board to flush mount the electrical connector onto the board. Interior cavity 24 of housing 12 is bounded by side walls 32, 34, 36 and 38 to define a generally cubic configuration for the housing. Actually, in the orientation of the housing in FIGS. 4 and 5 and the connector in FIGS. 1-3, side walls 32 and 36 actually are the top and bottom walls respectively, in the depicted orientation. However, it should be kept in mind that the connector is omnidirectional in use.

Figure 4A:
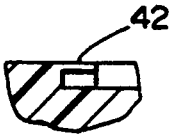
FIG. 4A is a fragmented section through the inner end of the locking recess on the outside of the housing.

Referring to FIG. 4A in conjunction with FIGS. 4 and 5, a recess 40 is formed in the front outer edge of wall 32, along with a lip 42 defining a closed inner end of the recess. As will be described in greater detail hereinafter, recess 42 is adapted for receiving a finger portion of shield 14.

Figure 4B:
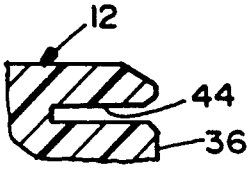
FIG. 4B is a fragmented section through one of the slots in the front face of the housing.

Referring to FIG. 4B in conjunction with FIGS. 4 and 5, housing 12 also has a pair of slots 44 in front face 28 at opposite sides of recess 40, near the upper opposite corners of the front face. As will be described in greater detail hereinafter, slots 44 are provided for receiving locking tabs of shield 14.

Figure 6:
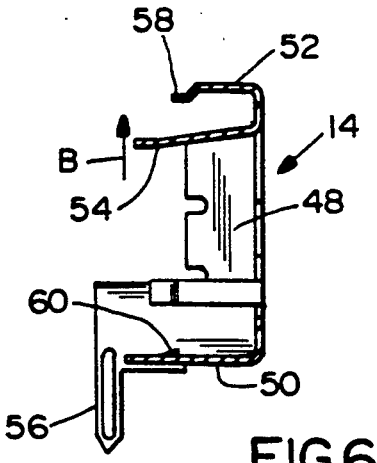
FIG. 6 is a vertical section through the shield of the connector.
Figure 7:
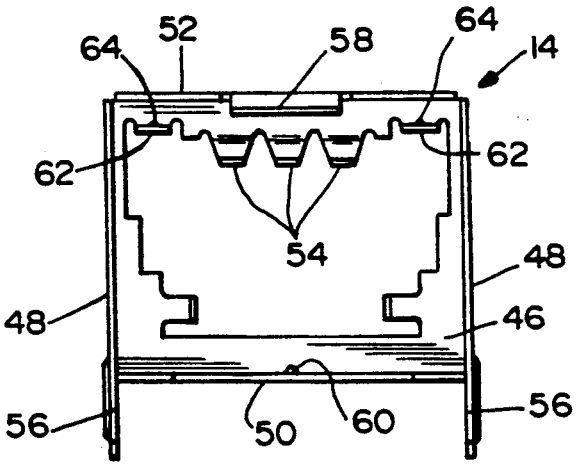
FIG. 7 is a rear elevational view of the shield.
Figure 8:
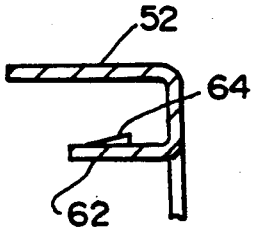
FIG. 8 is a fragmented view showing one of the locking tabs of the shield.

Referring to FIGS. 6-8 in conjunction with FIGS. 1-3, stamped and formed sheet metal shield 14 includes a front plate portion 46 for abutting front face 28 of housing 12. The shield has a pair of opposite side flange portions 48 extending rearwardly and overlying front areas of side walls 34 and 38 of the housing. A bottom flange portion 50 extends rearwardly and underlies a front area of bottom wall 36 of the housing. A rearwardly extending flange portion 52 of the shield overlies a front area of top wall 32 of the housing. Therefore, the shield totally surrounds the cubic housing in the front area thereof rearwardly of front face 28 of the housing.

As best seen in FIG. 6, shield 14 has a plurality of grounding spring fingers 54 projecting rearwardly into cavity 24 of housing 12. These spring fingers resiliently engage a ground component of the complementary mating connector, such as a ground shield of the mating connector. In addition, the shield has a pair of ground tails 56 depending from side flange portions 48 of the shield and extending below the shield (as well as the connector itself) for insertion into holes in the printed circuit board for electrical connection to ground traces on the board or in the holes.

Still referring particularly to FIG. 6, shield 14 includes a finger portion 58 at the rear edge of upper flange portion 52 for positioning into recess 40 (FIG. 4) of housing 12 such that the rear distal end of the spring finger seats beneath lip 42 (FIG. 4A) to retain the top of the shield on the housing. At least one barb 60 is formed out of rearwardly extending bottom flange portion 50 for snapping into a notch 61 (FIG. 4) on the underside of the housing to lock the shield onto the front of the housing.

Figure 9:
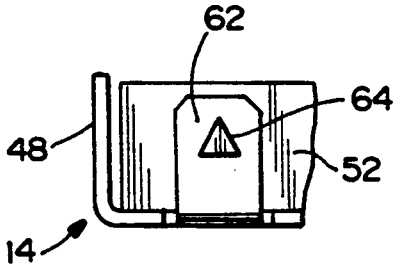
FIG. 9 is a fragmented plan view of one of the locking tabs of the shield.

Referring now to FIGS. 8 and 9, shield 14 is provided with locking tabs 62 extending rearwardly for insertion into slots 44 (FIGS. 1, 4B and 5) in the front face 28 of housing 12. Consequently, when the complementary mating connector is inserted into cavity 24 of housing 12, and the mating connector biases grounding spring fingers 54 upwardly in the direction of arrow "B" (FIG. 6), finger 58 of the shield positioned in the recess 40 and under lip 42 is prevented from moving up and locking tabs 62, being positioned in slots 44 of housing 12, prevent outward movement of the shield.

Lastly, as also alluded to in the "Background", above, problems also have been encountered in stamped and formed sheet metal shields of the character described herein, involving various locking tabs which are inserted into slots in a dielectric housing. More particularly, prior locking tabs have been stamped in a planar or flat configuration with lances or barbs stamped from and projecting outwardly of the edges of the locking tabs. With the ever-increasing miniaturization of semiconductor electrical connectors of the character described herein, such edge-stamped locking barbs or lances are difficult to fabricate in a stamping operation, are delicate and prone to breakage which results in losing the locking capabilities of the tabs, and are difficult to maintain of any viability whatsoever because of the small tolerances involved. Consequently, according to the invention, and referring again to FIGS. 8 and 9, it can be seen that each locking tab 62 is generally planar or flat and includes a locking barb 64 formed within the plane or within the bounds of the edges of the locking tab itself. This is in contrast to stamping locking lances or barbs in the edges of the locking tab. Locking barbs 64 are formed in the plane of the locking tab, such as in a stamping operation. The locking barbs 64 bite into the dielectric material in the top wall of slots 44 as best depicted in FIG. 4B. These formed locking barbs are much stronger than edge-stamped barbs and do not require any additional peripheral space.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector comprising;

a substantially rectangular cross-section dielectric housing having a front face, top, bottom and a pair of sidewalls enclosing a substantially rectangular opening extending rearwardly from the front face for receiving a mating connector, a one-piece, substantially rectangular, stamped and formed metal shield including a front plate portion for abutting the front face of the housing and having flanges extending partially along the top, bottom and each of the sidewalls, a locking finger portion extending from the top flange into a locking recess in the outside of the top wall, a grounding spring portion extending rearwardly from the front plate into the opening inside the top wall for engagement by the mating connector, a grounding spring finger extending rearwardly from the front plate into the opening inside each of the sidewalls for engagement with the mating connector, a barb projecting from the bottom flange for engaging a recess in the outside of the bottom wall to lock the shield onto the front of the housing, a pair of substantially rectangular slots located in the front face of the housing between the opening and the top wall thereof, each slot having its major surfaces substantially parallel to the top wall, a pair of locking tabs extending rearwardly from the flange, each tab having a generally planar configuration and including a locking barb formed within the plane thereof projecting into its respective slot to prevent movement of the shield during the engagement of the grounding spring portion by the mating connector and thereby preventing lifting of the locking finger portion of the shield out of the locking recess on the outside of the top wall.

2. In an electrical connector as set forth in claim 1, wherein the shield further includes a pair of ground tails extending from the side flanges for insertion into openings in the printed circuit board.

3. An electrical connector as set forth in claim 2, wherein the width of each locking tab is less than the width of its respective rectangular slot such that there is substantial clearance between the edges of each locking tab and the sides of its respective slot.

* * * * *